United States Patent [19]

Welch

[11] Patent Number: 4,884,807

[45] Date of Patent: Dec. 5, 1989

[54] PILE-SURFACED BALL AND METHOD OF MAKING THE SAME

[76] Inventor: James W. Welch, 1437 N. Manzanita, Unit G, Orange, Calif. 92667

[21] Appl. No.: 179,099

[22] Filed: Apr. 8, 1988

[51] Int. Cl.[4] ..... A63B 43/02; A63B 37/14; A63B 39/06

[52] U.S. Cl. ..... 273/58 C; 273/58 K; 273/DIG. 20; 273/58 BA; 273/61 R; 119/29; 428/95; 428/96; 428/11; 156/72

[58] Field of Search ..... 273/58 K, 58 C, 199 R, 273/199 A, 58 R, 58 B, 58 BA, 61 R, 428; 428/12, 85, 95, 96, 11; 156/72; 119/29

[56] References Cited

U.S. PATENT DOCUMENTS

| | | | |
|---|---|---|---|
| 1,580,230 | 4/1926 | Brereton | 273/199 R |
| 3,459,158 | 8/1969 | Mitchell, Jr. | 119/29 |
| 3,477,717 | 11/1969 | Clark | 273/58 C |
| 4,127,268 | 11/1978 | Lindgren | 273/58 C |
| 4,131,276 | 12/1978 | Judkins | 273/58 C |
| 4,321,888 | 3/1982 | Topliffe | 119/29 |
| 4,657,253 | 4/1987 | Lerner et al. | 273/58 A |

*Primary Examiner*—George J. Marlo
*Attorney, Agent, or Firm*—Robert W. Beach; Ward Brown

[57] ABSTRACT

A pile-surfaced toy ball is made by affixing to the exterior of a hollow rubber ball, such as a tennis ball, the inner end portions of stubs in closely spaced relationship by hotmelt, and when the hotmelt has set, the outer end portions of the stubs which can be of twisted strand rope or slit film in roll form can be fluffed by tumbling or combing to provide a dense pile surface. A tail such as of twisted strand rope can be attached to the ball during its manufacture by inserting in the core of the ball a knot on the end of the tail by movement through a slit in the core ball spread apart to enable the knot to pass into the interior of the ball by movement transversely of the length of the tail.

13 Claims, 2 Drawing Sheets

PILE-SURFACED BALL AND METHOD OF MAKING THE SAME

BACKGROUND OF THE INVENTION

1. Field of the Invention

This invention relates to a pile-surfaced ball which may or may not have a tail and the method of making such a ball.

2. Prior Art

The Judkins U.S. Pat. No. 4,131,276, issued Dec. 26, 1978, discloses a ball having a central core 18 from which arms 24 of plastic foam material extend radially outward. The ends 32 of such arms are of rectangular configuration and are spaced apart substantial distances. Consequently, the surface of such ball is quite different from the ball of the present invention.

The Mitchell, Jr., U.S. Pat. No. 3,459,158, issued Aug. 5, 1969, shows a tennis ball having a slit in it and a rod 13 extending from such tennis ball with a knob 14 housed in the tennis ball. The attachment of the rod to the tennis ball is somewhat similar to the attachment of a tail to the ball of the present invention.

The Lindgren U.S. Pat. No. 4,127,268, issued Nov. 28, 1978, shows a solid rubber ball having a tail, and Lerner et al. U.S. Pat. No. 4,657,253, issued Apr. 14, 1987, also shows a solid elastomer ball having a tail. The balls of these patents are considerably different from the ball of the present invention.

The Topliffe U.S. Pat. No. 4,321,888, issued Mar. 30, 1982, also shows a ball with tails, but, again, both the ball and the manner in which the tails are attached to it differ considerably from the ball of the present invention.

SUMMARY OF THE INVENTION

The principal object of the invention is to provide a ball that can be used as a toy for dogs or children that is light, yet durable, and has a surface that is soft and rugged.

It is also an object to provide such a ball to which a tail can be attached in secure fashion.

A more specific object is to provide a ball having a dense pile surface that is firm, while being resilient.

The foregoing objects can be accomplished by providing a ball having a conventional tennis ball as a core on which rope stubs are mounted projecting radially outward from the core and having the strands at their outer ends untwisted and frayed to form tight strand clusters producing a dense pile.

DETAILED DESCRIPTION

Figure 1:
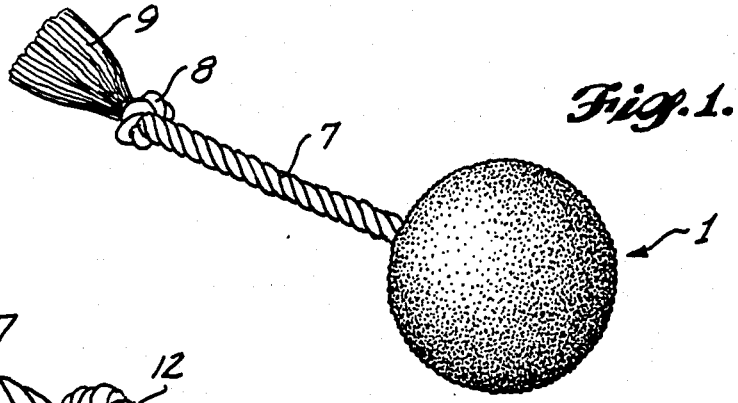
FIG. 1 is a top perspective of a ball according to the present invention having a rope tail.
Figure 4:
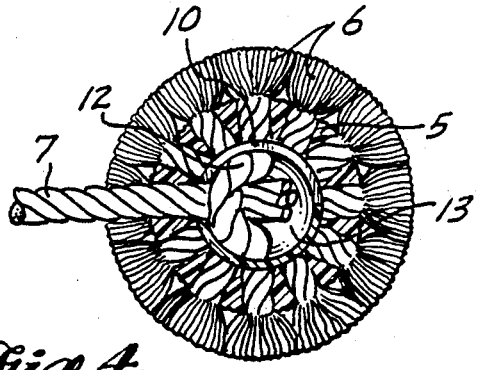
FIG. 4 is a similar diametral section showing the completed ball.

The ball 1 of the present invention has a dense but velvety and resilient pile surface, as shown in FIG. 1. Such ball may be made in different sizes and have a pile surface of different depths depending upon the particular use for which it is intended. The size of the ball can range from a diameter of 2 or 3 inches (5.1 cm or 7.6 cm) to a diameter of 10 of 12 inches (25.4 cm to 30.48 cm), but a convenient practical size is a ball having a diameter of 5 or 6 inches (12.7 cm or 15.24 cm).

the ball 1 has a core in the form of a hollow rubber ball 2 which conveniently can be a tennis ball. The pile surface shown in FIG. 4 is made of strand clumps formed by rope stubs 3, having their butts butting the periphery of the ball 2 in closely spaced arrangement and bonded to each other and to such ball. Such bonding can be effected by dipping an end of each of the rope stubs in adhesive such as hotmelt to form a gob 4 of adhesive around its inner end, then pushing the stub endwise against the surface of the ball 2 in closely spaced arrangement with other rope stubs and repeating this operation until the entire surface of the ball 2 is bristling with such rope stubs. It is preferably for such rope stubs to be of material which will melt and fuse, such as nylon or polyethylene. In such case the inner rope ends are fused to prevent untwisting before they are dipped in hotmelt.

Figure 3:
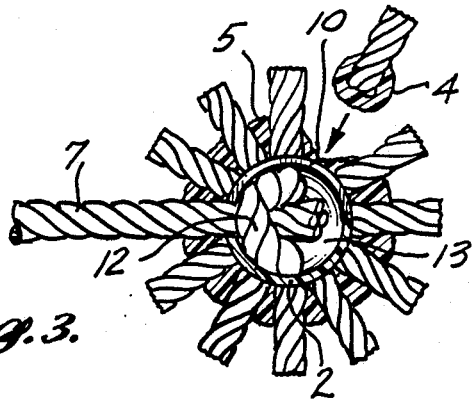
FIG. 3 is a diametral section through the ball at an intermediate stage of its manufacture, one component of the ball being shown in exploded relationship.

The size of the ball would, of course, be determined by the size of the core ball 2 and the lengths of the stubs 3, but the lengths of the stubs shown in FIG. 3 are approximately equal to the ball diameter. Also, the softness of the surface will depend on the diameter of the rope stubs. For a ball 5 or 6 inches (12.7 cm or 15.24 cm) in diameter, it is desired to use rope stubs of ½ inch (1.27 cm), 5/8 inch (1.57 cm) or ¾ inch (1.91 cm) in diameter.

When the rope stubs 3 have been affixed to the ball 2 with their butts in closely spaced relationship, as shown in FIG. 3, the hotmelt 5 will form a coating interconnecting the inner ends of the rope stubs to a substantial depth, perhaps as much as one-half of the length of the stubs, as shown in FIG. 3.

When the hotmelt 5 has solidified, the outer end portions of the rope stubs 3 are untwisted and frayed or fluffed to form tightly packed strand clusters producing deep nap or pile tassels or tufts 6, as shown in FIG. 4. Such untwisting and fraying or fluffing can be accomplished in various ways, such as by tumbling the ball or balls in a drum or by combing or raking the twisted outer end portions of the rope stubs to fray them and produce the surface nap. The pile can be made more dense and uniform by shearing the outer ends after such tumbling or combing.

If desired, a tail 7 may be provided for the ball which preferably is of twisted rope. Near the end of such tail remote from the ball, a knot 8 is formed in the rope and the end portion of the rope beyond the knot is untwisted and frayed or fluffed to form a tassel 9.

Figure 2:
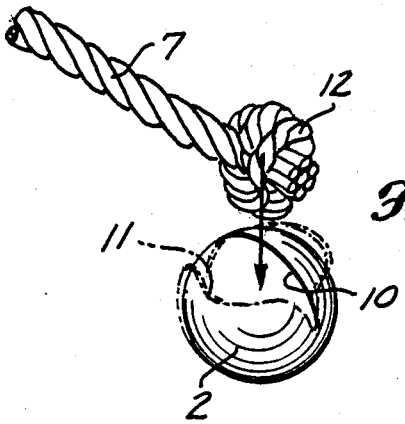
FIG. 2 is a similar view showing the core of the ball and the tail shown in exploded relationship.

To attach the tail 7 to the ball having a core made of a tennis ball 2, a diametral or great circle slit 10 is cut in the ball over approximately one-half of its circumference and one end portion of such slit is split or the end of such slit is connected to an aperture 11 in the ball of a size to receive the tail 7 which may be a rope of ½ inch (1.27 cm), 5/8 inch (1.57 cm) or ¾ inch (1.91 cm) in diameter. The opposite sides of slit 10 can be pried apart to the broken line position shown in FIG. 2 so that a knot 12 in the end of tail 7 of a size to fill the major portion of the ball interior cavity can be moved through the spread slit, as indicated in FIG. 2, in a direction transversely of the length of the tail until the knot has been received within the cavity of the core ball 2, as shown in FIG. 3. If desired, hotmelt may be inserted into the ball interior cavity through the slit 10 to bond the knot 12 to the interior of the ball.

Figure 5:
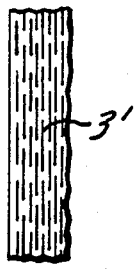
FIG. 5 is a fragmentary side elevation of a portion of a component of a modified type of ball.
Figure 6:
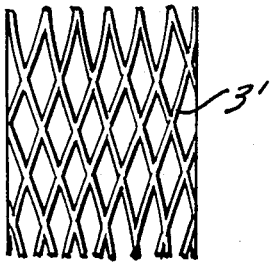
FIG. 6 is a similar view of such component in expanded condition.
Figure 7:
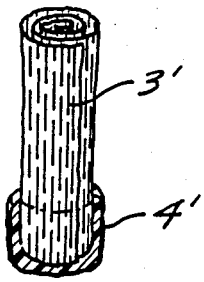
FIG. 7 is a top perspective of a component of the ball made of material such as shown in FIGS. 5 and 6.
Figure 8:
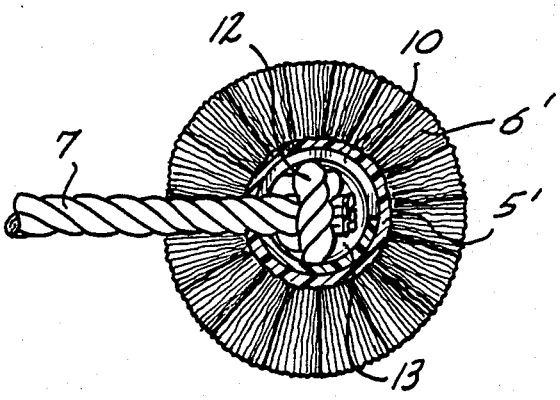
FIG. 8 is a diametral section corresponding to FIG. 4 through a ball having a modified construction and utilizing components such as shown in FIG. 7.

The construction of the ball 1' shown in FIG. 8 is similar to the construction of the ball shown in FIG. 4, except in this instance the stubs or strand clumps are different. The stubs 3' in this instance are made of slit webbing or plastic film material that can be spread from the condition shown in FIG. 5 to the condition shown in FIG. 6 to form expanded film similar to the structure of expanded metal. Initially, the slit film will be folded or roller to the form of the strand clumps or stubs shown in FIG. 7, cut to desired length and the inner end portions of the clumps dipped to form a hotmelt coating 4'. The butt portions of the stubs 3' are applied to the surface of the tennis ball 2, as described in connection with the ball shown in FIG. 3. The outer end portions of the stubs 3' are then frayed or fluffed to rupture the slits in the material and form tightly packed strand clusters producing a dense pile or nap surface similar to the pile formed by the rope stubs, as described in connection with FIG. 4.

The slit plastic film material 3' is like the material used to form artificial turf.

While the rope stubs 3 can all be of the same color, an attractive pile finish effect can be obtained by using rope stubs of different colors to provide a mottled color effect or, in fact, any desired colored design.

I claim:

1. A ball having a dense pile surface comprising a cluster of stubs of stranded frayable material having their inner end portions bonded together in closely spaced relationship and their outer end portions frayed or fluffed to form the dense pile surface composed of tightly packed clusters of frayed or fluffed strands.

2. The ball defined in claim 1, in which the stubs are of twisted rope.

3. The ball defined in claim 1, in which the stubs are of expandable slit film.

4. The ball defined in claim 1, having a hollow ball core to the outer surface of which the inner end portions of the stubs are adhesively bonded.

5. The ball defined in claim 4, including a tail having a knotted end portion received within the hollow ball core and of a size to fill the major portion of the ball core hollow.

6. The ball defined in claim 1, having a hollow ball core to the outer surface of which the inner end portions of the stubs are adhesively bonded, the length of the stubs being approximately equal to the diameter of said ball core.

7. The ball defined in claim 1, having a hollow ball core to the outer surface of which the inner end portions of the stubs are adhesively bonded, the length of the stubs being a major portion of the length of the diameter of said ball core.

8. The method of making a ball having a dense pile or nap surface comprising adhesively bonding the inner end portions of stubs of stranded frayable material together in closely spaced relationship and thereafter fraying or fluffing the outer end portions of such stubs to form a pile surface composed of tightly packed clusters of frayed or fluffed strands.

9. The method defined in claim 8, in which the stubs are of twisted rope and the fraying or fluffing includes untwisting the outer end portions of the stubs.

10. The process defined in claim 8, including bonding the inner end portions of the stubs to each other and to a core ball.

11. The process defined in claim 10, including slitting the core ball along a great circle, spreading such slit and inserting through the spread slit an enlargement of a tail in a direction transversely of the length of the tail.

12. A ball having a dense nap surface portion comprising clumps of stranded material having their end portions adhesively bonded together and their outer end portions frayed or fluffed to form dense nap composed of tightly packed clusters of frayed or fluffed strands.

13. The ball defined in claim 12, in which the clumps are of expandable slit film.

* * * * *

UNITED STATES PATENT AND TRADEMARK OFFICE

CERTIFICATE OF CORRECTION

PATENT NO. : 4,884,807

DATED : December 5, 1989

INVENTOR(S) : James W. Welch

It is certified that error appears in the above-identified patent and that said Letters Patent is hereby corrected as shown below:

Claim 12: column 4, line 38, before "end" insert --inner--.

Signed and Sealed this

Twentieth Day of November, 1990

*Attest:*

HARRY F. MANBECK, JR.

*Attesting Officer*

*Commissioner of Patents and Trademarks*